US008056976B1

(12) United States Patent
Polk

(10) Patent No.: US 8,056,976 B1
(45) Date of Patent: Nov. 15, 2011

(54) CHAIR WITH MULTIPLE PIVOT AXES

(76) Inventor: Louis F. Polk, Excelsior, MN (US)

( * ) Notice: Subject to any disclaimer, the term of this patent is extended or adjusted under 35 U.S.C. 154(b) by 43 days.

(21) Appl. No.: 12/578,875

(22) Filed: Oct. 14, 2009

(51) Int. Cl.
*A47C 3/02* (2006.01)

(52) U.S. Cl. ..... 297/271.5; 297/258.1; 297/270.1; 297/270.5; 297/344.1; 297/451.13; 297/452.17; 297/452.41

(58) Field of Classification Search ..... 297/451.13, 297/452.41, DIG. 3, 258.1, 270.1, 270.5, 297/271.2, 271.5, 272.4, 311, 344.1; 482/142, 482/126, 121
See application file for complete search history.

(56) References Cited

U.S. PATENT DOCUMENTS

| | | | | |
|---|---|---|---|---|
| 2,999,688 | A * | 9/1961 | Gabrielson | 472/25 |
| 3,716,229 | A * | 2/1973 | Van Der Cleyen et al. | 482/77 |
| 4,037,833 | A * | 7/1977 | Anderson | 472/102 |
| 4,084,273 | A * | 4/1978 | Haynes | 5/105 |
| 4,141,588 | A * | 2/1979 | Anderson | 297/271.5 |
| 4,180,062 | A | 12/1979 | Alberti et al. | |
| 4,703,975 | A | 11/1987 | Roberts et al. | |
| 5,112,103 | A * | 5/1992 | Downer | 297/270.1 |
| 5,364,161 | A | 11/1994 | Liu | |
| D353,460 | S | 12/1994 | Reynolds et al. | |
| 5,601,528 | A * | 2/1997 | Mancarella | 601/45 |
| 5,690,389 | A | 11/1997 | Ekman et al. | |
| 5,785,633 | A * | 7/1998 | Stroppiana | 482/77 |
| 5,853,329 | A * | 12/1998 | Worlds et al. | 472/25 |
| 6,070,943 | A | 6/2000 | Guery-Strahm | |
| 6,141,807 | A * | 11/2000 | Tapper | 5/653 |
| 6,146,343 | A * | 11/2000 | Stewart | 601/118 |
| 6,299,247 | B1 * | 10/2001 | Meeker et al. | 297/137 |
| 6,390,559 | B1 * | 5/2002 | Schnitzhofer | 297/452.41 |
| 6,447,070 | B1 * | 9/2002 | Ekman et al. | 297/452.41 |
| 6,520,578 | B1 * | 2/2003 | Jospa et al. | 297/217.1 |
| 6,616,238 | B1 * | 9/2003 | Guery-Strahm | 297/452.41 |
| 6,702,388 | B1 | 3/2004 | Chiu | |
| 6,832,817 | B1 | 12/2004 | Chiu | |
| 6,837,835 | B2 * | 1/2005 | Huang | 482/126 |
| 6,854,800 | B2 * | 2/2005 | Perego | 297/148 |
| 7,118,517 | B1 * | 10/2006 | Hale | 482/140 |
| D536,542 | S | 2/2007 | Chiu | |
| 7,341,548 | B2 * | 3/2008 | Heitzman et al. | 482/142 |
| 7,588,522 | B2 * | 9/2009 | Heitzman | 482/142 |
| 7,604,581 | B1 * | 10/2009 | Williams | 482/140 |
| 2005/0143234 | A1 * | 6/2005 | Massey | 482/140 |
| 2009/0325770 | A1 * | 12/2009 | Baschnagel | 482/142 |

FOREIGN PATENT DOCUMENTS

EP 563820 A1 * 10/1993

OTHER PUBLICATIONS

ObsessionFitness.com, Gaiam Balance Ball Chair, http://obsessionfitness.com/gaiam-balance-ball-chair-combines-exercise-ergonomic back-support/(last visited Jan. 7, 2010).

FitBuy.com, Ball Chair, http://www.fitbuy.com/pd/bd23009.html (last visited Jan. 7, 2010).

* cited by examiner

*Primary Examiner* — Laurie Cranmer
(74) *Attorney, Agent, or Firm* — Haugen Law Firm PLLP

(57) ABSTRACT

A chair apparatus is provided with multiple pivot axis for improving core strength, posture, and circulation of the user. The chair apparatus includes a seat portion that is capable of pivotal movement about multiple pivot axes and along a surface. The chair apparatus further includes a frame coupled to the seat portion, wherein the frame limits the pivotal movement of the seat portion only when the chair apparatus is placed in a supported orientation.

23 Claims, 9 Drawing Sheets

CHAIR WITH MULTIPLE PIVOT AXES

FIELD OF THE INVENTION

The present invention relates to a seating apparatus generally, and more particularly to a chair which facilitates dynamic sitting through pivotal movement about a plurality of pivot axes.

BACKGROUND OF THE INVENTION

Furniture designers have long sought ways in which to improve the ergonomic quality of chairs, particularly those which are used for relatively long continuous time periods. One example type of chair that qualifies for this type of use is an office chair, though several other varieties of chairs may also be used for long continuous periods. Often times, such chairs are provided with numerous adjustment capabilities in order to enable a certain extent of customizability and conformability to the physical attributes of the particular user. Most typically, however, such chairs nevertheless provide only a static seating environment, in which the chair provides substantially all of the support necessary to maintain the user in a stable, upright position.

The static seating relationship offered by typical chairs can result in detrimental effects to the user. For example, the support provided by the chair induces the user to refrain from using muscles that are otherwise necessary in maintaining an upright orientation. Moreover, the static seating arrangement can lead to a degradation of correct upright posture, which then potentially leads to muscle soreness and fatigue, particularly for the muscles controlling vertebral orientation.

It has been discovered that the use of inflatable balloons, such as exercise balls, fitness balls, and the like, as seating devices causes the users to utilize core muscles required in maintaining an upright posture. The use of such muscles throughout the sitting period maintains the strength of such muscles, while not overburdening muscles which wouldn't otherwise be so directly involved. This effect is most dramatically realized in the use of such inflatable balloons alone, as the user is required to continuously maintain a balanced position upon the balloon because the balloon does not itself provide a balanced and "static" seating condition. This constant balancing effort by the user can be referred to as a "dynamic" seating condition.

Some efforts have been directed to combining the use of an inflatable balloon with a more conventional chair, such as an office chair. For example, several designs have been proposed which essentially replace the substantially horizontal seat element of a chair with an exercise ball which is then fitted and secured in a static condition to a chair frame. While such designs seek to introduce the benefits of dynamic seating to a conventional chair configuration, the fixation of the exercise ball in a static condition within a chair frame substantially mitigates the benefits derived from dynamic seating.

Accordingly, there exists a need to provide an apparatus that is capable of providing both dynamic and static seating conditions.

There is also a need to provide a chair apparatus which facilitates both dynamic and static seating conditions, and is adjustable to be used comfortably and correctly by users of various size.

SUMMARY OF THE INVENTION

By means of the present invention, the chair apparatus enables, at the user's discretion, either dynamic or static seating conditions. The present chair apparatus maintains the beneficial seating attributes of, for example, an exercise or fitness ball, while also providing the option of using the chair apparatus in a static seating condition. The present chair apparatus further provides a plurality of adjustment capabilities so as to most comfortably and correctly conform to the physical size of the user.

In one embodiment, a chair apparatus with multiple pivot axes includes a seat portion having a contact portion capable of pivotal movement about the multiple pivot axes and along a surface. The contact portion defines an upper tangential plane including an upper tangent point of the contact portion, and a lower tangential plane including a lower tangent point on the contact portion. The lower tangential plane may be substantially parallel to the upper tangential plane. The chair apparatus further includes a frame which limits, but still enables, pivotal movement only when the chair apparatus is placed in a supported orientation. The chair apparatus further includes a retention mechanism that is adapted to removably secure the seat portion to the frame.

In another embodiment, a chair apparatus with multiple pivot axes includes a seat portion that is capable of pivotal movement about the multiple pivot axes and along a surface. The chair apparatus further includes a frame which limits pivotal movement about one or more of the multiple pivot axes only when the chair apparatus is placed in a supported orientation.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various embodiments of the invention. Other embodiments and aspects of the invention are recognized as being within the grasp of those having ordinary skill in the art.

For the purposes of this application, the term "dynamic seating condition" shall mean a condition in which the act of sitting requires balancing effort by the user in order to maintain an upright orientation on a seating device prone to pivotal movement about one or more pivot axes substantially parallel to a ground or floor surface. The term "static seating condition" shall mean a condition in which the seating device is restricted from or not prone to pivotal movement about one or more pivot axes substantially parallel to a group or floor surface.

Figure 1A:
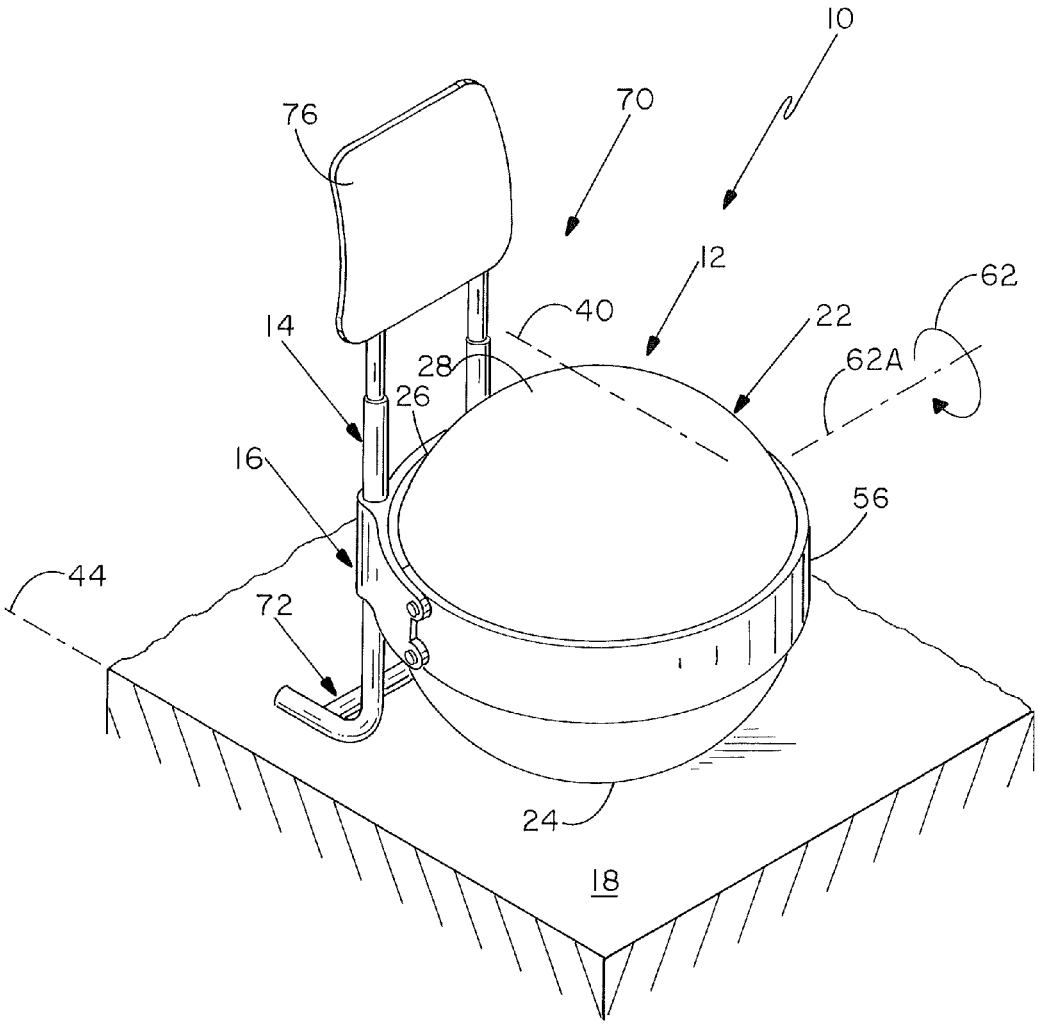
FIG. 1A is a perspective view of a chair apparatus of the present invention.

With reference now to the drawing figures, and first to FIG. 1A, a chair apparatus 10 includes a seat portion 12, a frame 14, and a retention mechanism 16 adapted to removably secure seat portion 12 to frame 14. As will be described in greater detail hereinbelow, chair apparatus 10 is configured for pivotal movement about a plurality of pivot axes and along a surface 18. Such pivotal movement facilitates a dynamic seating condition when a user is positioned at seat portion 12 of chair apparatus 10. However, frame 14 is configured to limit the range of pivotal movement by chair apparatus 10, such that a static seating condition may be accomplished when chair apparatus 10 is placed in a certain orientation. As a consequence, chair apparatus 10 provides a user selection between a dynamic and a static seating condition. Moreover, chair apparatus 10 may be conveniently stored in the orientation in which a static seating condition is accomplished.

In one embodiment, seat portion 12 includes a contact portion as an inflatable balloon 22 having a substantially spherical shape when in an unstressed condition. Inflatable balloon 22 may be, for example, a conventional exercise ball or fitness ball, or may instead be specifically manufactured as a seat portion for chair apparatus 10. To that end, inflatable balloon 22 may be fabricated from a variety of materials that are known to be relatively durable, flexible, and lightweight. In one embodiment, inflatable balloon 22 may have a shell that is fabricated from vinyl, rubber, plastic, leather, or other gas-impermeable material. Inflatable balloon 22 may include an internal bladder which may be inflated against the outer shell of inflatable balloon 22 by the injection of a fluid thereto, such as air. In other embodiments, however, inflatable balloon 22 is comprised of only an outer shell that may be selectively inflatable with a fluid, such as air.

In some embodiments, seat portion 12 may include a contact portion that is a solid or otherwise non-inflatable structure, such as a solid ball, disc, hemi-sphere, or the like. The solid or non-inflatable structure may be fabricated from a relatively light weight material, such as a foam or non-foam polymer. It is contemplated, however, that seat portion 12 may be embodied in a variety of configurations and materials which facilitate the dynamic seating condition of the present invention. In one aspect, seat portion 12 may have a contact portion with a rounded or otherwise radiused lower surface 24 which operably engages with surface 18, which may be a ground or floor surface. Due to the radiused or otherwise irregular configuration of lower surface 24, seat portion 12 may pivot about a plurality of axes, as well as along surface 18, such as through a "rolling" movement.

Figure 2:
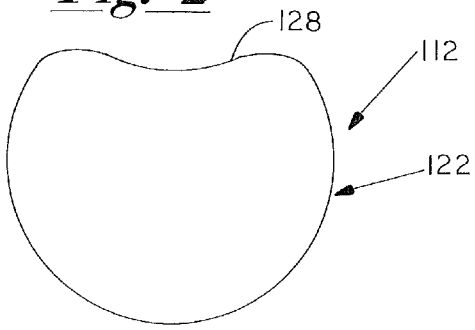
FIG. 2 is an isolation view of a seat portion of the chair apparatus of the present invention.

In addition to the generally spherical shape described above, seat portion 12 may assume a variety of configurations that are deemed to be most suitable for the particular application. In the embodiment illustrated in FIG. 2, for example, seat portion 12 includes an inflatable balloon 122 having an upper surface 128 which may be formed into a "saddle"-type configuration to accommodate a seated user. A wide variety of configurations for upper surface 28 of seat portion 12, as well as the configuration of the remainder of seat portion 12, are contemplated by the present invention. For example, inflatable balloon 22 may be spherical, aspherical, ovular, irregular, and so on.

Figure 3:
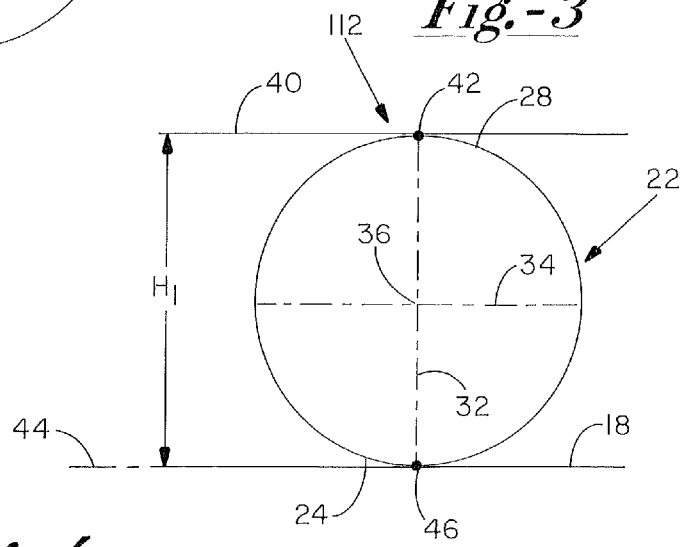
FIG. 3 is an isolation view of a seat portion of the chair apparatus of the present invention.

An isolation view of inflatable balloon 22 of chair apparatus 10 is illustrated in FIG. 3, wherein the illustrated embodiment of inflatable balloon 22 is substantially spherical in an unstressed condition. It is contemplated that the flexibility characteristics of inflatable balloon 22 may result in the alteration from the spherical configuration during use. For example, a first major axis 32, which may be oriented substantially perpendicular to surface 18, may be compressed upon seating of a user at upper surface 28. Such compression of first major axis 32 may correspondingly expand inflatable balloon 22 along second major axis 34. A further potential alteration to the external configuration of inflatable balloon 22 is the constriction of inflatable balloon 22 along second major axis 34 through the operation of retention mechanism 16. In one embodiment, constriction of inflatable balloon 22 along second major axis 34 results in an increase to the dimension of inflatable balloon 22 along first major axis 32. In doing so, an overall height dimension "$H_1$" may be increased to, for example, accommodate relatively tall users. In an unstressed condition, height dimension "$H_1$" may be between about 20-30 inches. For the purposes of this description, second major axis 34 of inflatable balloon 22 may be substantially parallel to surface 18, which may be the ground or floor upon which chair apparatus 10 is disposed.

As further illustrated in the isolation view of FIG. 3, inflatable balloon 22 defines an upper tangential plane 40 including an upper tangent point 42 at upper surface 28 of balloon 22. Moreover, a lower tangential plane 44 includes a lower tangent point 46 on balloon 22, wherein lower tangential plane 44 is substantially parallel to upper tangential plane 40. In one embodiment, upper tangent point 42 is oppositely disposed from lower tangent point 46, and may be oppositely disposed along first major axis 32 of balloon 22. In some embodiments, inflatable balloon 22 may include a center 36 about which inflatable balloon 22 may rotationally pivot. It is also contemplated, however, that other configurations for balloon 22, including aspherical configurations, include inner radial points about which balloon 22 may rotationally pivot. In each of such cases, rotational movement involves a plurality of pivot axes extending through the inner radial pivot point. In the case of a spherical balloon 22, rotational movement involves pivot axes extending through center 36.

Figure 4:
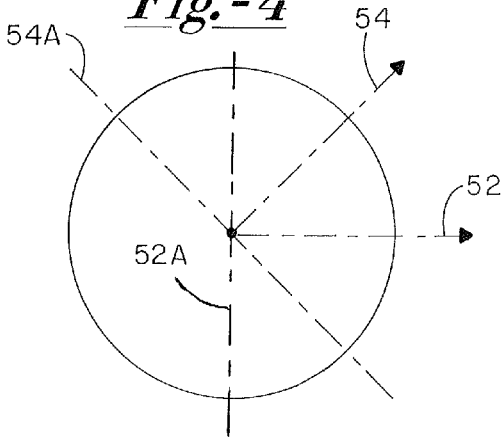
FIG. 4 is an isolation view of a seat portion of the chair apparatus of the present invention.

As can be readily understood, rotational movement of balloon 22 along surface 18 may involve pivotal movement about a plurality of pivot axes which are substantially parallel to surface 18. In the example top isolation view of inflatable balloon 22 in FIG. 4, rotational movement along direction 52 involves pivotal movement about pivot axis 52A. Likewise, rotational movement of inflatable balloon 22 along direction 54 involves pivotal movement about pivot axis 54A. In this example, because inflatable balloon 22 rotates along surface 18, pivot axes 52A, 54A are substantially parallel to surface 18.

Figure 5:
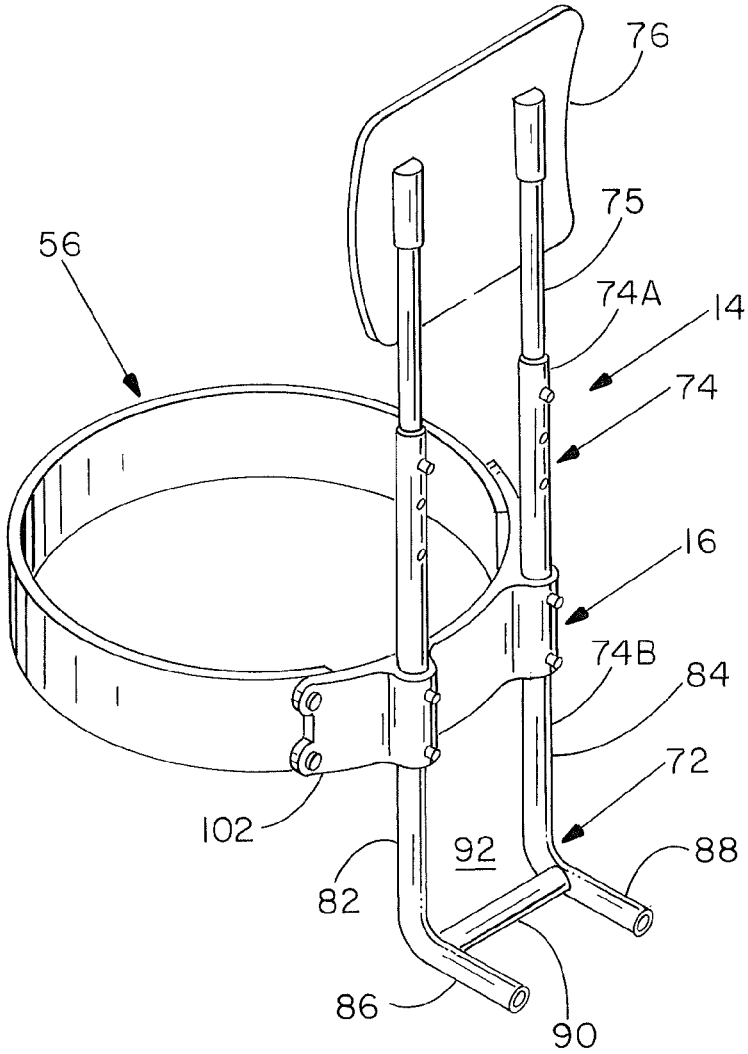
FIG. 5 is an isolation view of a frame of the chair apparatus of the present invention.

With reference now to FIGS. 1A and 5, seat portion 12 is stabilized and restricted in its pivotal movement to an extent by frame 14. As can be readily understood, frame 14 restricts pivotal motion 62 about pivot axis 62A by coming into contact with surface 18 when secured to seat portion 12. Such an orientation is referred to herein as supported orientation 70. Because frame 14 only limits the pivotal movement of inflatable balloon 22 when placed in supported orientation 70, chair apparatus 10 maintains the capability of providing both a dynamic and a static seating condition.

It is contemplated that frame 14 may assume a variety of configurations for partially limiting the range of pivotal motion of chair apparatus 10. In the illustrated embodiment, frame 14 includes a pivot stabilizer portion 72 and an upright portion 74. As illustrated, upright portion 74 of frame 14 may extend beyond upper tangential plane 40. Upright portion 74 of frame 14 may extend substantially perpendicular to upper tangential plane 40.

A further aspect of frame 14 may be the provision of a back rest 76, such that a user may lean against back rest 76 in the operation of chair apparatus 10. It is contemplated that frame 14 and back rest 76 may be provided in a variety of configurations, operations, and materials. In the illustrated embodiment, upright portion 74 of frame 14 includes first and second main tubes 82, 84 which are spaced apart and extend substantially parallel to one another in a tangential direction from rear surface 26.

In one embodiment, first and second main tubes 82, 84 may be fabricated from a relatively light weight but strong material, such as aluminum, relatively thin-walled steel, composites, or polymeric materials. Upright portion 74 of frame 14 may instead include a single upright tube or member, which may optionally support back rest 76. Back rest 76 may be a molded or fabric material that may be supported by and/or coupled to frame 14.

Figure 6:
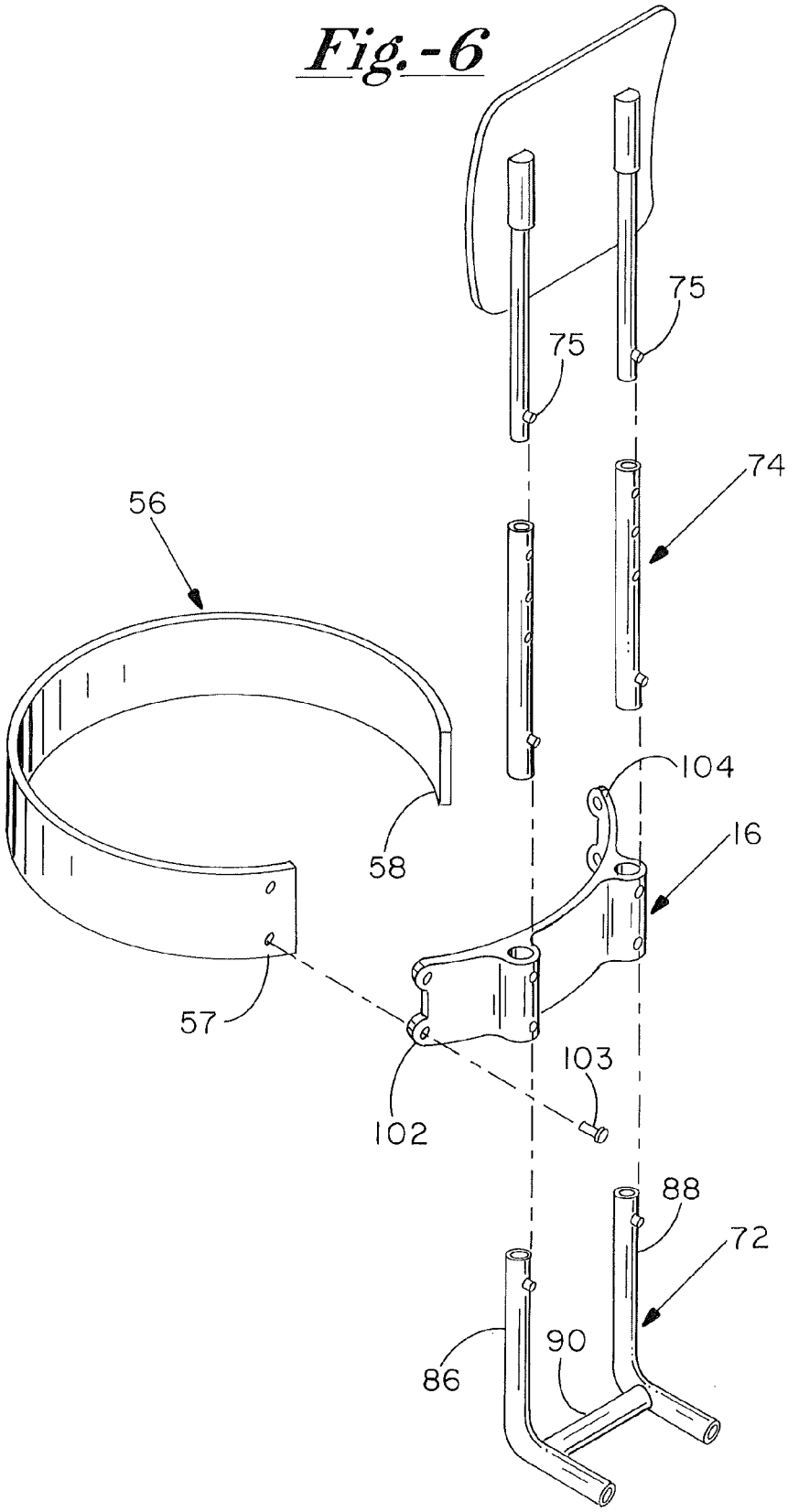
FIG. 6 is a component view of the frame illustrated in FIG. 5.

As illustrated in FIG. 5, at least upright portion 74 of frame 14 may be selectively extensible along the tangential direction. Such selective extensibility may be provided to accommodate different sized seat portions 12 and/or different sized users. In the embodiment illustrated in FIG. 6, upright portion 74 of frame 14 may be segmented into respective telescoping portions including locking mechanisms 75 which may be selectively engaged at different points of telescopic extension to lockingly adjust an overall length of upright portion 74 of frame 14. Other mechanisms for selectively extending upright portion 74 of frame 14 are, of course, contemplated by the present invention.

Upright portion 74 of frame 14 may be theoretically divided by retention mechanism 16 into an upper portion 74A and a lower portion 74B. In some embodiments, upright portion 74 of frame 14 may be selectively extensible only at upper portion 74A or at lower portion 74B. In other embodiments, however, upright portion 74 may be separately selectively extensible at each of upper and lower portions 74A, 74B. In such embodiments, lower portion 74B may be selectively extensible in order to best accommodate the size of seat portion 12, while upper portion 74A may be selectively extensible to best accommodate the size of the user so as to position back rest 76 at an appropriate support location of the user's back.

Upright portion 74 of frame 14 may also have a pivoting feature, wherein backrest 76 may be pivoted about a pivot axis to establish a selectively customizable angle of recline from the remainder of frame 14. It is contemplated that any of a variety of conventional pivot mechanisms may be employed to provide back rest 76 with an adjustable recline angle.

Figure 1B:
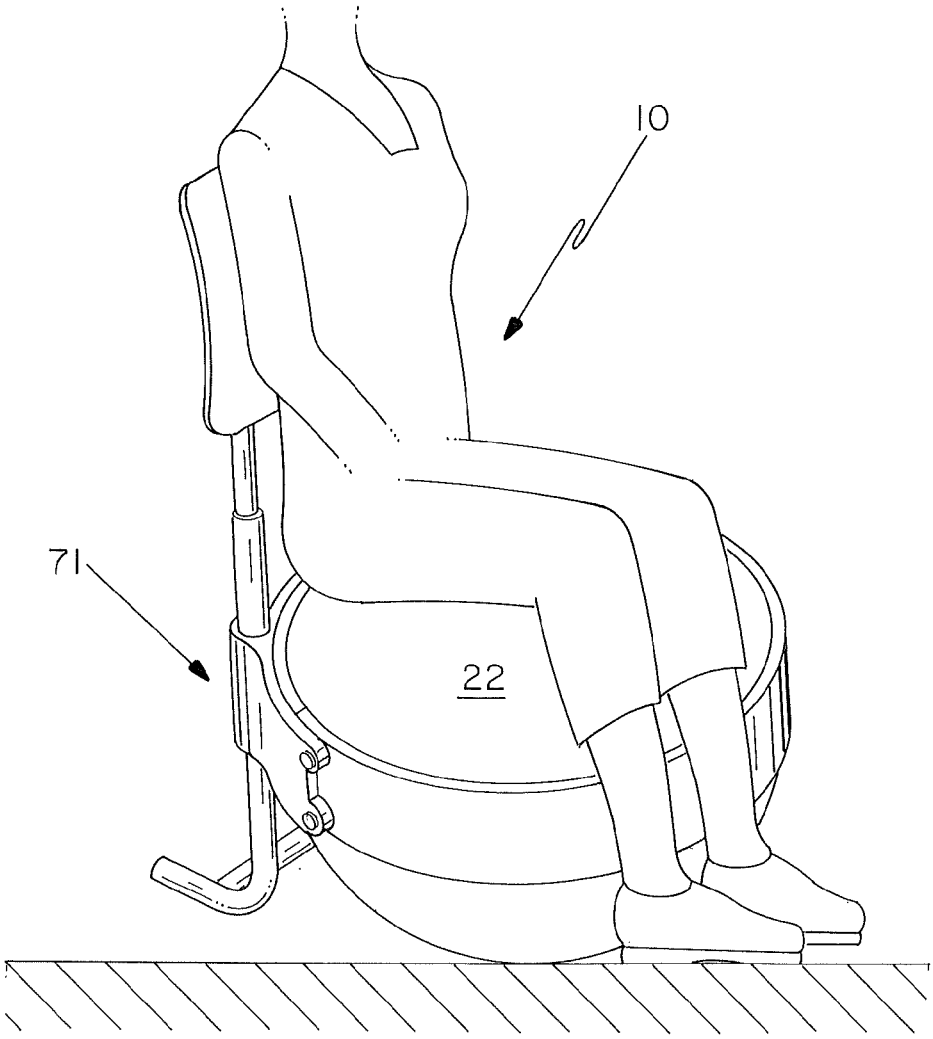
FIG. 1B is a perspective view of the chair apparatus illustrated in FIG. 1A in use.

Pivot stabilizer portion 72 of frame 14 may extend from upright portion 74 to suitably support chair apparatus 10 in a stable condition when chair apparatus 10 is placed in supported orientation 70. In one embodiment, pivot stabilizer portion 72 is disposed between upper and lower tangential planes 40, 44, such that upright portion 74 of frame 14 is non-vertically oriented in the supported orientation 70. Such an arrangement is illustrated in FIGS. 1 and 1A, wherein chair apparatus 10 is in a dynamic seating condition in FIG. 1A, in an orientation in which frame 14 is substantially perpendicular to lower tangential plane 44. The positioning of pivot stabilizer portion 72 between upper and lower tangential planes 40, 44 may facilitate an aspect of the present invention, wherein a dynamic seating condition 71 is provided while upright portion 74 of frame 14 is in a substantially vertical orientation. Thus, typical use of chair apparatus 10, as illustrated in FIG. 1B, involves a dynamic seating condition. To establish a static seating condition, chair apparatus 10 is rotated, for example, about pivot axis 62A until pivot stabilizer portion 72 is in contact with surface 18, and upright portion 74 of frame 14 is in a non-vertical "reclined" orientation. In this manner, users may operate chair apparatus 10 in a static seating condition when frame 14 and back rest 76 provides a reclined orientation for the user. In other embodiments, however, pivot stabilizer portion 72 may be configured in such a manner so as to provide a static seating condition in other frame orientations, such as a vertical frame orientation.

In the embodiment illustrated in FIGS. 1A and 5, pivot stabilizer portion 72 substantially comprises a u-shaped portion extending between first and second main tubes 82, 84. The u-shaped portion of pivot stabilizer portion 72 includes first and second foot portions 86, 88, and a connector portion 90 connecting first and second foot portions 86, 88. In this embodiment, first and second foot portions 86, 88 extend from upright portion 74 in a direction away from inflatable balloon 22, and substantially parallel to lower tangential plane 44. It should be understood, however, that pivot stabilizer portion 72 may be provided in a variety of configurations. Moreover, pivot stabilizer portion 72 may be selectively extensible in a direction away from inflatable balloon 22. For example, first and second foot portions 86, 88 may be selectively extensible so as to selectively enlarge or reduce a foot print area 92 defined between first and second foot portions 86, 88, connector portion 90, and a plane of upright portion 74 of frame 14.

As further illustrated in the drawings, chair apparatus 10 may include a retention mechanism 16, which itself includes a securement body 56 which may be selectively engaged about at least a portion of inflatable balloon 22. In one embodiment, securement body 56 may be a strap that is selectively engagable with first and second connector portions 102, 104 of retention mechanism 16. First and second connector portions 102, 104 may be secured to upright portions 74 of frame 14 with, for example, a fastener 103, such that operable retention of securement body 56 about inflatable balloon 22 secures inflatable balloon 22 to frame 14.

A number of mechanisms are contemplated as being useful in retention mechanism 16. In one example, a first end 57 of securement body 56 is fixedly attached to first connector portion 102 of retention mechanism 16, while second end 58 of securement body 56 is releasably securable to second connector portion 104. In other embodiments, however, either or both of first and second ends 57, 58 of securement body 56 may be selectively attached to first and/or second connector portions 102, 104 of retention mechanism 16. Moreover, first and second ends 57, 58 of securement body 56 may be permanently secured to respective first and second connector portions 102, 104 of retention mechanism 16. In such an embodiment, inflatable balloon 22 may be secured to frame 14 by securement body 56. The extent of inflation of inflatable balloon 22 may also impact the extent of constraint of inflatable balloon 22 along second major axis 34. For example, increased inflation of inflatable balloon 22 may cause inflatable balloon 22 to expand along first major axis 32, as a result of a substantially inflexible securement body 56. In other embodiments, however, securement body 56 may be sufficiently flexible to comply with various inflation pressures of inflatable balloon 22.

In one embodiment of the invention, a length of securement body 56 extending between first and second connection portions 102, 104 may be selectively adjustable. To do so, one or both of first and second ends 57, 58 of securement body 56 may be operated in a conventional belt or strap tightening arrangement to reduce the length of securement body 56 between first and second connector portions 102, 104. Such reduction or expansion of the effective length of securement body 56 acts to increase or decrease constraint of inflatable balloon 22, such as along second major axis 34.

Figure 10:
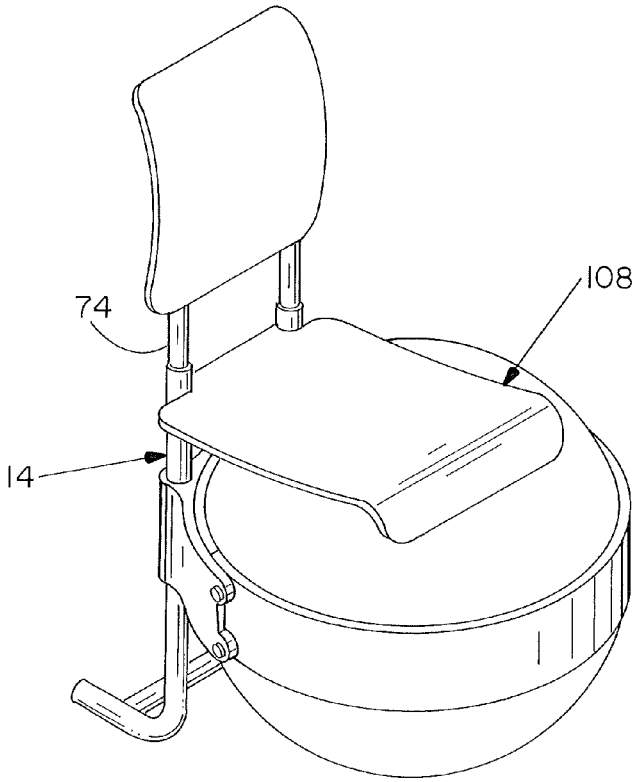
FIG. 10 is a perspective view of a chair apparatus of the present invention.

In one embodiment of chair apparatus 10, a user may sit directly upon upper surface 28 of inflatable balloon 22, or may instead sit upon a covering or other material surrounding at least a portion of inflatable balloon 22. In other embodiments, however, a separate and distinct seat element 108, as illustrated in FIG. 10 may be provided as secured to upright portion 74 of frame 14. In this embodiment, seat element 108 may be in a substantially fixed orientational relationship with frame 14, while the pivotal motion of chair apparatus 10 is still provided by inflatable balloon 22. In this manner, a seat element 108 that may provide desired long-term comfort to the user may be provided without eliminating the dynamic seating condition characteristics of chair apparatus 10. In still further embodiments, seat element 108 may be pivotally or removably secured to frame 14 to provide users with the option to use either seat element 108 or upper surface 28 as the seating surface of chair apparatus 10.

In another embodiment of the invention, chair apparatus 210 includes a seat portion 212 and a frame 214, wherein frame 214 may be operably secured directly to seat portion 212. In the illustrated embodiment, seat portion 212 includes frame receptacles 266, 268 which are secured to, or integral with, seat portion 212. Frame receptacles 266, 268 may be molded into the body of seat portion 212, so as to form channels external to, or separate from, an inner chamber of inflatable balloon 222. Frame receptacles 266, 268 may be configured to operably receive first and second main tubes 282, 284 of frame 214. In one embodiment, frame receptacles 266, 268 may be configured to frictionally retain respective first and second main tubes 282, 284 therein. In such a manner, inflatable balloon 222 may be coupled to frame 214 at desired locations along first and second main tubes 282, 284.

Figure 7:
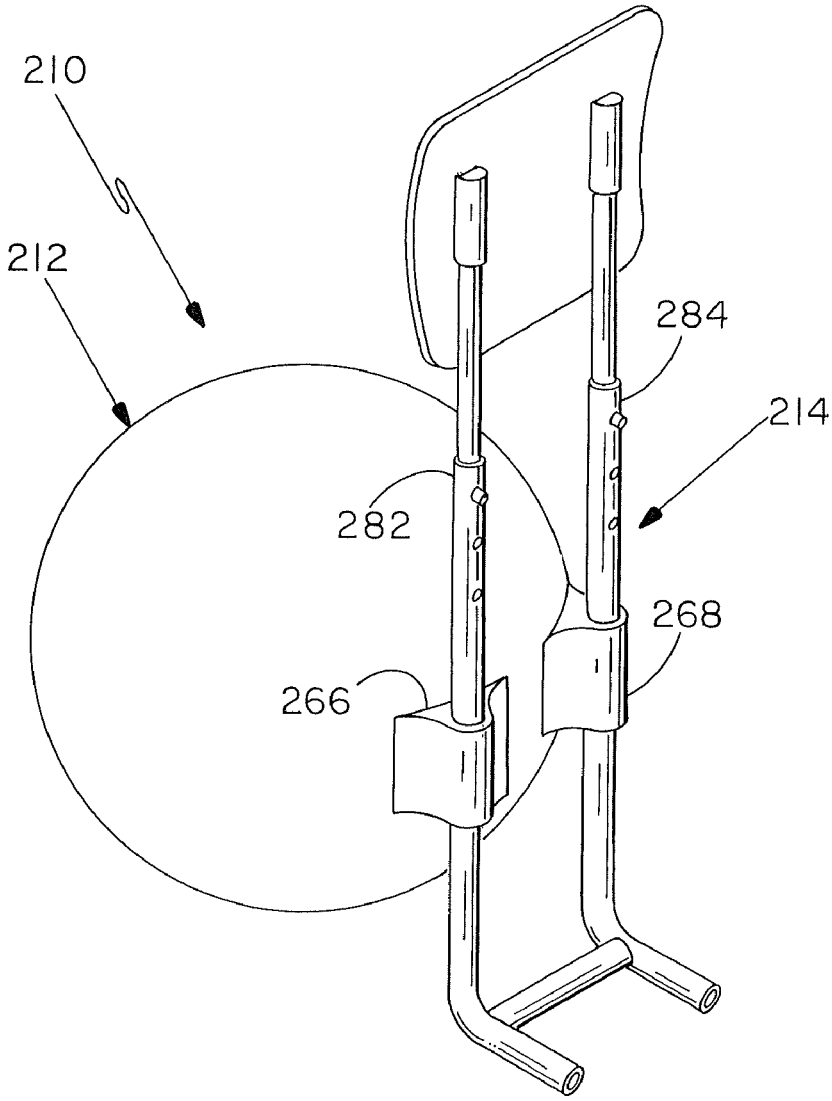
FIG. 7 is a perspective view of a chair apparatus of the present invention.

The embodiment illustrated in FIG. 7 enables chair apparatus 210 to operate as described above without the need for a retention mechanism, such as retention mechanism 16. Here, securement of inflatable balloon 222 to frame 214 is accomplished at first and second frame receptacles 266, 268. Moreover, the desired functionality of providing both dynamic and static seating conditions may be accomplished through appropriate arrangement of the elements illustrated in FIG. 7.

A variety of mechanisms and configurations are contemplated for operably coupling seat portion 212 to frame 214. Specifically, it is to be understood that the exact mechanism by which seat portion 212 and frame 214 are operably coupled is not critical to the present invention, but rather the mere fact that seat portion 212 may be coupled to frame 214 in some fashion which enables, or does not interfere with, the dual dynamic/static seating conditions described herein.

Figure 8:
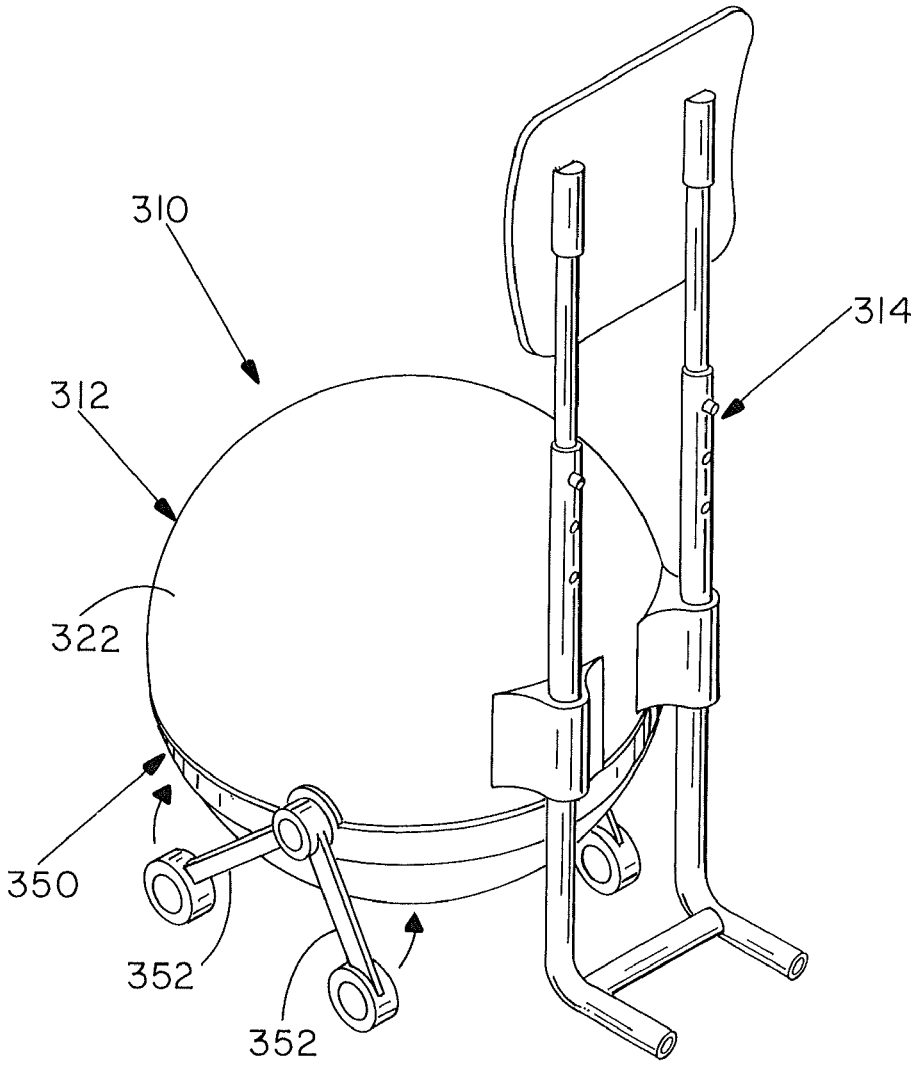
FIG. 8 is a perspective view of a chair apparatus of the present invention.

In a still further embodiment, as illustrated in FIG. 8, chair apparatus 310 includes a seat portion 312, a frame 314 coupled to seat portion 312, and a retractable wheel apparatus 350. In the illustrated embodiment, retractable wheel apparatus 350 may be positioned about at least a portion of seat portion 312 in such a manner so as to enable retractable wheels 352 to selectively engage surface 18. It is contemplated by the present invention that retractable wheel apparatus 350 may be provided to selectively disengage ball 322 from surface 18 for replacement by a set of, for example, wheels 352. In this arrangement, retractable wheels 352 may be selectively pivoted into an operating orientation, as illustrated in FIG. 8 to engage with surface 18, and to thereby provide a static seating condition for chair apparatus 310. Retractable wheels 352 may be pivoted or otherwise brought out of engagement with surface 18 to thereby re-establish engagement between ball 322 and surface 18 for re-establishing a dynamic seating condition. It is to be understood that retractable wheels 352 may be selectively engaged or disengaged with surface 18 through a variety of mechanisms, including pivot mechanisms, axial extension mechanisms, or any other of a variety of known techniques. Retractable wheel apparatus 350 may be secured to frame 314 and/or seat portion 312 of chair apparatus 310.

It is also to be understood that retractable wheels 352 may be replaced as desired with other implements, such as static feet fixtures. The replacement of retractable wheels 352 with other accessories may provide other desired characteristics for chair apparatus 310, including sliding movement and stable positioning. In all cases, however, retractable wheel mechanism 350 may be provided as an additional or alternative means for selectively establishing a static seating condition, while retaining the option of a dynamic seating position when ball 322 is engaged with surface 18.

Figure 9:
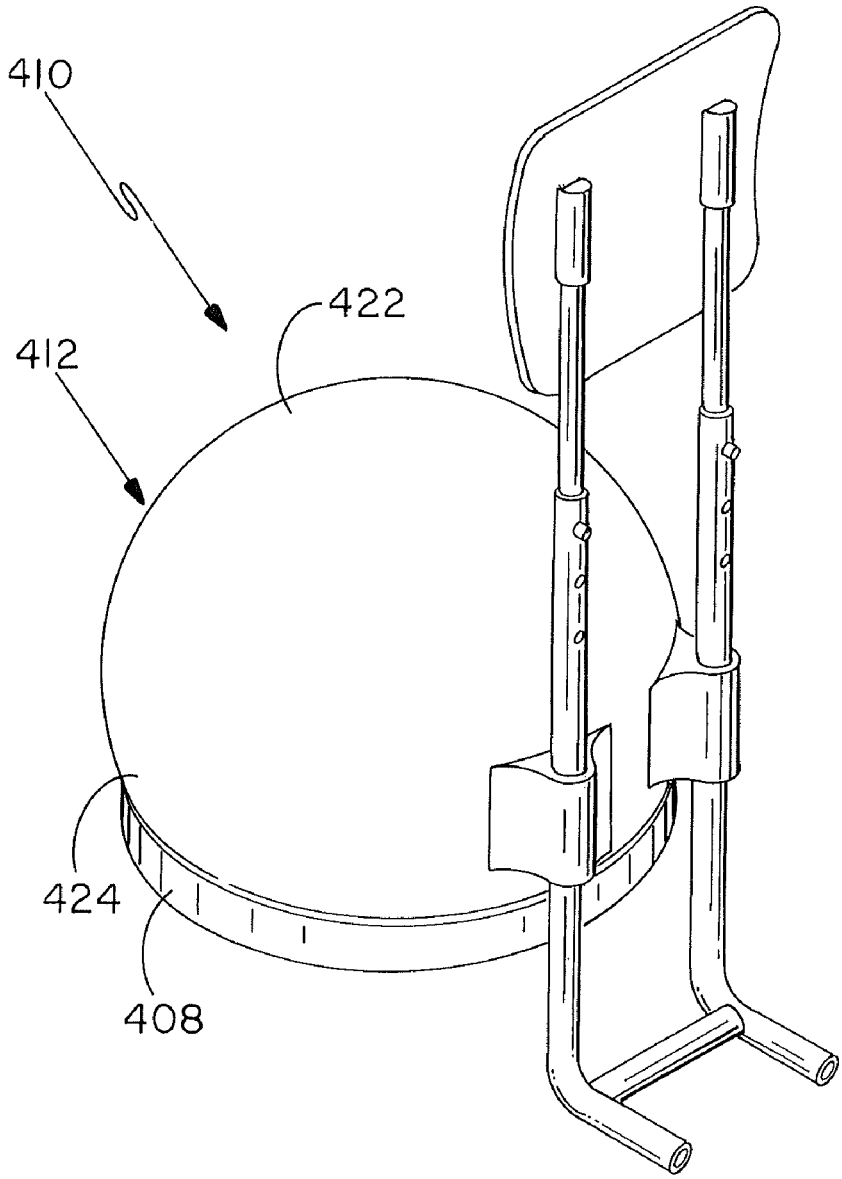
FIG. 9 is a perspective view of a chair apparatus of the present invention.

In a yet further embodiment, illustrated in FIG. 9, chair apparatus 410 may include a sliding structure 408 having a relatively low coefficient of friction for engagement with lower surface 424 of seat portion 412. In some embodiments, sliding structure 408 may substantially take the form of a semi-spherical bowl which conforms to the outer periphery of at least lower surface 424 of ball 422. Sliding structure 408, with its relatively low coefficient of friction, enables chair apparatus 410 to be easily slid along surface 18, while still retaining the dynamic seating conditions of the present invention.

Sliding structure 408 may be fabricated from a variety of materials, though polymeric materials may be most useful for their lightweight and low frictional resistance characteristics. In some embodiments, ball 422 may be simply placed into sliding structure 408, while in other embodiments, a connection mechanism may be provided between sliding structure 408 and ball 422. In one example, a connection mechanism may include hook and loop type fasteners, such as those provided under the tradename Velcro®, to removably connect sliding structure 408 to ball 422. It is contemplated, however, that a variety of connection mechanisms may be employed to permanently or removably secure sliding structure 408 to ball 422.

Applicant contemplates a variety of embodiments for the present invention which involve the selected positioning of an apparatus between dynamic and static seating conditions. In one example embodiment, the apparatus of the present invention may incorporate exercise equipment secured to or integrally formed with a seat portion capable of a dynamic seating condition. In such an embodiment, the exercise equipment, such as weightlifting equipment, resistance equipment, and the like, may be connected to, or form at least a portion of a frame for the apparatus, which frame facilitates a selective static seating condition when engaged with the ground or floor surface in a similar manner as that described above with respect to frame 14. Accordingly, it is contemplated that a variety of attachments and configurations may be employed in the apparatus of the present invention to facilitate use in both the dynamic and static seating conditions.

The invention has been described in considerable detail in order to comply with the patent statutes, and to provide those skilled in the art with the information needed to apply the novel principles and to construct and use embodiments of the invention as required. However, it is to be understood that various modifications may be accomplished without departing from the scope of the invention itself.

What is claimed is:

1. A chair apparatus with multiple pivot axes, said chair apparatus comprising:

(a) a seat portion comprising an inflatable balloon capable of pivotal movement about said multiple pivot axes and along a surface, said inflatable balloon defining an upper tangential plane including an upper tangent point on said balloon, and a lower tangential plane including a lower tangent point on said balloon, said lower tangential plane being substantially parallel to said upper tangential plane, said balloon further defining a midplane extending substantially perpendicularly between said upper and lower tangential planes to substantially bisect said balloon into a front portion on a first side of said mid-plane and a rear portion on a second side of said mid lane;

(b) a frame limiting such pivotal movement only when said chair apparatus is placed in a supported orientation with a pivot stabilizer portion of said frame in contact with said surface; and (c) a retention mechanism adapted to removably secure said seat portion to said frame, wherein said frame includes said pivot stabilizer portion only on said second side of said midplane.

2. A chair apparatus as in claim 1 wherein said pivotal movement includes rotational movement about a center of said inflatable balloon.

3. A chair apparatus as in claim 1 wherein said frame includes an upright portion extending beyond said upper tangential plane on said second side of said midplane.

4. A chair apparatus as in claim 3 wherein said upright portion extends substantially perpendicular to said upper tangential plane.

5. A chair apparatus as in claim 3, including a back rest at said upright portion.

6. A chair apparatus as in claim 3, wherein said upright portion is selectively extensible along a lengthwise direction.

7. A chair apparatus as in claim 3, wherein said pivot stabilizer portion is disposed between said upper and lower tangential planes.

8. A chair apparatus as in claim 7 wherein said pivot stabilizer portion extends from said upright portion and in a direction away from said inflatable balloon substantially parallel to said lower tangential plane.

9. A chair apparatus as in claim 3 wherein said upright portion includes first and second upright members received within respective frame receptacles of said retention mechanism, said first and second upright members being aligned substantially parallel to a rear portion tangent plane which extends through a rear tangent point on said balloon substantially perpendicularly to said upper and lower tangent planes.

10. A chair apparatus as in claim 9 wherein said frame receptacles are integrally molded with said inflatable balloon.

11. A chair apparatus as in claim 1 wherein said retention mechanism includes a strap selectively engaged about at least a portion of said inflatable balloon.

12. A chair apparatus as in claim 11 wherein said retention mechanism is secured to said frame.

13. A chair apparatus as in claim 11 wherein a length of said strap about said inflatable balloon is adjustable.

14. A chair apparatus as in claim 13 wherein shortening of said strap constrains said inflatable balloon in a first radial direction, thereby causing said inflatable balloon to expand along an axial direction.

15. A chair apparatus as in claim 14 wherein said axial direction is substantially parallel to said upright portion of said frame.

16. A chair apparatus comprising:

(a) a contact portion for supporting said apparatus upon a surface, said contact portion defining a plurality of pivot axes, and being capable of pivotal movement about said multiple pivot axes and along a surface; and (b) a frame which limits such pivotal movement about one or more of said multiple pivot axes only when said chair apparatus is placed in a supported orientation, wherein said chair apparatus is capable of being placed in only a single supported orientation, but is capable of being placed in a plurality of dynamic orientations in which said frame does not limit such pivotal movement.

17. A chair apparatus as in claim 16 wherein said supported orientation is defined by contact between said frame and the surface.

18. A chair apparatus as in claim 16 wherein said contact portion is part of a seat portion of said chair apparatus.

19. A chair apparatus as in claim 18 wherein said contact portion is secured to said seat portion.

20. A chair apparatus, comprising:

(a) a radiused contact portion operably engagable with a surface to support said apparatus upon the surface, and defining a plurality of pivot axes about which said contact portion is capable of pivoting while in contact with the surface, said plurality of pivot axes extending through at least a respective one of one or more pivot points, at least one of said pivot points being within a dividing plane of said chair apparatus, said dividing plane dividing said chair apparatus into a front side and a rear side;

(b) a frame having a pivot stabilizer portion defining a foot print area along a plane substantially perpendicular to said dividing plane, said pivot stabilizer portion contacting the surface to limit movement of said chair apparatus about at least one of said pivot axes only when said chair apparatus is in a supported orientation, said pivot stabilizer portion being provided only on said rear side of said dividing plane; and (c) a seat portion coupled to said frame.

21. A chair apparatus as in claim 20 wherein said radiused contact portion has a radius of between about 10-15 inches.

22. A chair apparatus as in claim 20 wherein said seat portion comprises a seat element that is spaced from said contact portion.

23. A chair apparatus with multiple pivot axes, said chair apparatus comprising:

(a) a substantially spherical seat portion having a frame receptacle integrally molded therewith; and (b) a frame configured to engage within said frame receptacle, and to establish a static seating condition by limiting pivotal movement of said chair apparatus about at least one of said pivot axes in only a single orientation of said chair apparatus.

* * * * *